US009610589B2

(12) United States Patent
Siegfried et al.

(10) Patent No.: US 9,610,589 B2
(45) Date of Patent: Apr. 4, 2017

(54) ELECTROSTATIC PARTICLE COLLECTOR WITH IMPROVED FEATURES FOR INSTALLING AND/OR REMOVING ITS COLLECTOR PLATES

(71) Applicant: Savannah River Nuclear Solutions, LLC, Aiken, SC (US)

(72) Inventors: Matthew J. Siegfried, North Augusta, SC (US); Daniel R. Radford, North Augusta, SC (US); Russell K. Huffman, Augusta, GA (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 124 days.

(21) Appl. No.: 14/718,165

(22) Filed: May 21, 2015

(65) Prior Publication Data

US 2016/0339447 A1 Nov. 24, 2016

(51) Int. Cl.

| | |
|---|---|
| ***B03C 3/00*** | (2006.01) |
| ***B03C 3/32*** | (2006.01) |
| ***B03C 3/34*** | (2006.01) |
| ***B03C 3/82*** | (2006.01) |

(Continued)

(52) U.S. Cl.
CPC . *B03C 3/47* (2013.01); *B03C 3/41* (2013.01)

(58) Field of Classification Search
CPC combination set(s) only.
See application file for complete search history.

(56) References Cited

U.S. PATENT DOCUMENTS 2,233,639 A * 3/1941 Pegg ..... B03C 3/72 96/25
2,639,781 A * 5/1953 Savitz ..... B03C 3/12 200/61.03

(Continued)

FOREIGN PATENT DOCUMENTS

CN 102912074 A 2/2013
GB 2451058 A 1/2009

OTHER PUBLICATIONS

Patent Cooperative Treaty International Searching Authority—Search Report and Written Opinion, dated Aug. 4, 2016. (8 pages).

(Continued)

*Primary Examiner* — Duane Smith
*Assistant Examiner* — Sonji Turner
(74) *Attorney, Agent, or Firm* — Dority & Manning, P.A.

(57) ABSTRACT

An electrostatic particle collector may generally include a housing having sidewalls extending lengthwise between a first end and a second end. The housing may define a plate slot that extends heightwise within the housing between a top end and a bottom end. The housing may further include a plate access window that provides access to the bottom end of the plate slot. The collector may also include a collector plate configured to be installed within the plate slot that extends heightwise between a top edge and a bottom edge. Additionally, when the collector plate is installed within the plate slot, the bottom edge of the collector plate may be accessible from an exterior of the housing via the plate access window so as to allow the bottom edge of the collector plate to be moved relative to the housing to facilitate removal of the collector plate from the housing.

20 Claims, 11 Drawing Sheets

(51) Int. Cl.
*B03C 3/47* (2006.01)
*B03C 3/41* (2006.01)

(56) References Cited

U.S. PATENT DOCUMENTS 3,040,498 A * 6/1962 Berly ..... B03C 3/12 96/79
3,222,848 A * 12/1965 Koble, Jr. ..... B03C 3/82 312/308
3,626,668 A * 12/1971 Cardiff ..... B03C 3/155 55/282
3,665,679 A * 5/1972 McLain ..... B03C 3/86 55/481
3,733,783 A * 5/1973 Burney ..... B03C 3/72 96/26
3,740,926 A * 6/1973 Duval ..... B03C 3/32 55/481
3,778,970 A * 12/1973 Swimmer ..... B03C 3/86 96/58
4,057,405 A * 11/1977 Cheney ..... B03C 3/766 55/300
4,147,522 A 4/1979 Gonas et al.
4,290,788 A * 9/1981 Pittman ..... B03C 3/66 55/481
4,772,297 A * 9/1988 Anzai ..... B03C 3/155 96/19
5,071,455 A * 12/1991 Abedi-Asl ..... B03C 3/017 126/110 R
5,938,818 A 8/1999 Miller
6,126,727 A * 10/2000 Lo ..... H01T 23/00 95/75
6,544,317 B2 4/2003 Miller
7,297,185 B2 11/2007 Furuta et al.
7,641,718 B2 1/2010 Furuta et al.
7,717,984 B1 * 5/2010 Schreiber ..... B03C 3/08 96/30
7,822,355 B2 10/2010 Schlitz
8,043,412 B2 * 10/2011 Carlson ..... B03C 3/011 95/64
8,444,754 B2 5/2013 June et al.
8,539,840 B2 9/2013 Ariessohn et al.
2002/0062739 A1 * 5/2002 Cheng ..... B03C 3/82 96/66
2004/0144254 A1 * 7/2004 Wiser, III ..... B01D 46/0005 96/66
2004/0179981 A1 9/2004 Lau et al.
2005/0051028 A1 * 3/2005 Botvinnik ..... B03C 3/47 96/88
2006/0018808 A1 1/2006 Taylor et al.
2006/0278074 A1 * 12/2006 Tseng ..... B03C 3/32 95/57
2007/0157813 A1 7/2007 Spiegel
2007/0214958 A1 9/2007 Leng et al.
2007/0295207 A1 12/2007 Thomas et al.
2008/0053307 A1 3/2008 Liang
2011/0000368 A1 1/2011 Tollens
2013/0047857 A1 2/2013 Bohlen
2013/0047858 A1 2/2013 Bohlen et al.
2013/0047859 A1 2/2013 Bohlen

OTHER PUBLICATIONS

Air Purifier—Eachome Houseware (HK) Cp., LTD. As of May 20, 2015. (10 Pages).

* cited by examiner

ELECTROSTATIC PARTICLE COLLECTOR WITH IMPROVED FEATURES FOR INSTALLING AND/OR REMOVING ITS COLLECTOR PLATES

STATEMENT AS TO RIGHTS TO INVENTIONS MADE UNDER FEDERALLY SPONSORED RESEARCH

This invention was made with Government support under Contract No. DE-AC09-08SR22470 awarded by the United States Department of Energy. The Government has certain rights in the invention.

FIELD OF THE INVENTION

The present subject matter relates generally to electrostatic particle collectors and, more particularly, to an electrostatic particle collector with improved design features for facilitating insertion and/or removal of its collector plates.

BACKGROUND OF THE INVENTION

Electrostatic particle collectors (ESPs), also referred to as electrostatic precipitators, are commonly utilized in industry and other applications to provide a means for collecting airborne particles. Typically, ESPs include a housing through which a gas flow (e.g., an air flow) is passed. A plurality of thin wires and one or more collector plates are contained within the housing along the gas flow path. A negative or positive voltage is applied between the wires and the plate(s) to create an electric corona discharge that ionizes the gas flow, with the resulting ions flowing to the collector plates and charging any particles contained within the gas flow. The ionized particles are then attracted to and collect on the collection surface(s) of the collector plate(s).

As is generally understood, to analyze the particle samples, the collector plate(s) must be removed from the ESP housing. Unfortunately, with conventional ESP configurations, it is often difficult for the user to remove the collector plate(s) from the housing without contacting the collection surface(s) of the plate(s). As a result, there is often some amount of sample loss and/or sample contamination associated with removal of the collector plates. Moreover, when replacing the collector plate(s) of an ESP, it is desirable to be able to accurately and efficiently install the plate(s) within the ESP housing. However, conventional ESP configurations typically lack any features to allow for the accurate and efficient placement of the collector plate(s) within the ESP housing.

Accordingly, an improved ESP configuration and/or design that provides suitable features for facilitating removal of the collector plate(s) of the ESP in a manner that minimizes sample loss/contamination would be welcomed in the technology. In addition, or as an alternative thereto, an improved ESP configuration and/or design that provides suitable features for allowing the collector plate(s) to be accurately and efficiently installed therein would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to an electrostatic particle collector. The collector may generally include a housing having first and second sidewalls extending lengthwise between a first end and a second end. The housing may define a plate slot that extends heightwise within the housing between a top end and a bottom end. The housing may further include a plate access window defined in the housing so as to provide access to the bottom end of the plate slot. The collector may also include a collector plate configured to be installed within the plate slot. The collector plate may extend heightwise between a top edge and a bottom edge and lengthwise between a first side edge and a second side edge. Additionally, when the collector plate is installed within the plate slot, the bottom edge of the collector plate may be accessible from an exterior of the housing via the plate access window so as to allow the bottom edge of the collector plate to be pushed in the direction of the top end of the plate slot to facilitate removal of the collector plate from the housing.

In another aspect, the present subject matter is directed to a method for removing and/or installing components used within an electrostatic particle collector, wherein the electrostatic particle collector includes a housing and a collector plate. The housing may include first and second sidewalls extending lengthwise between a first end and a second end of the housing. The housing may also define a plate slot that extends heightwise within the housing between a top end and a bottom end. The method may generally include accessing, when the collector plate is installed within the housing, a bottom edge of the collector plate via a plate access window defined through the housing, wherein the plate access window is defined in the housing at a location adjacent to the bottom end of the plate slot. In addition, the method may include applying a force against the bottom edge of the collector plate so as to cause the collector plate to be moved relative to the housing in the direction of the top end of the plate slot.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
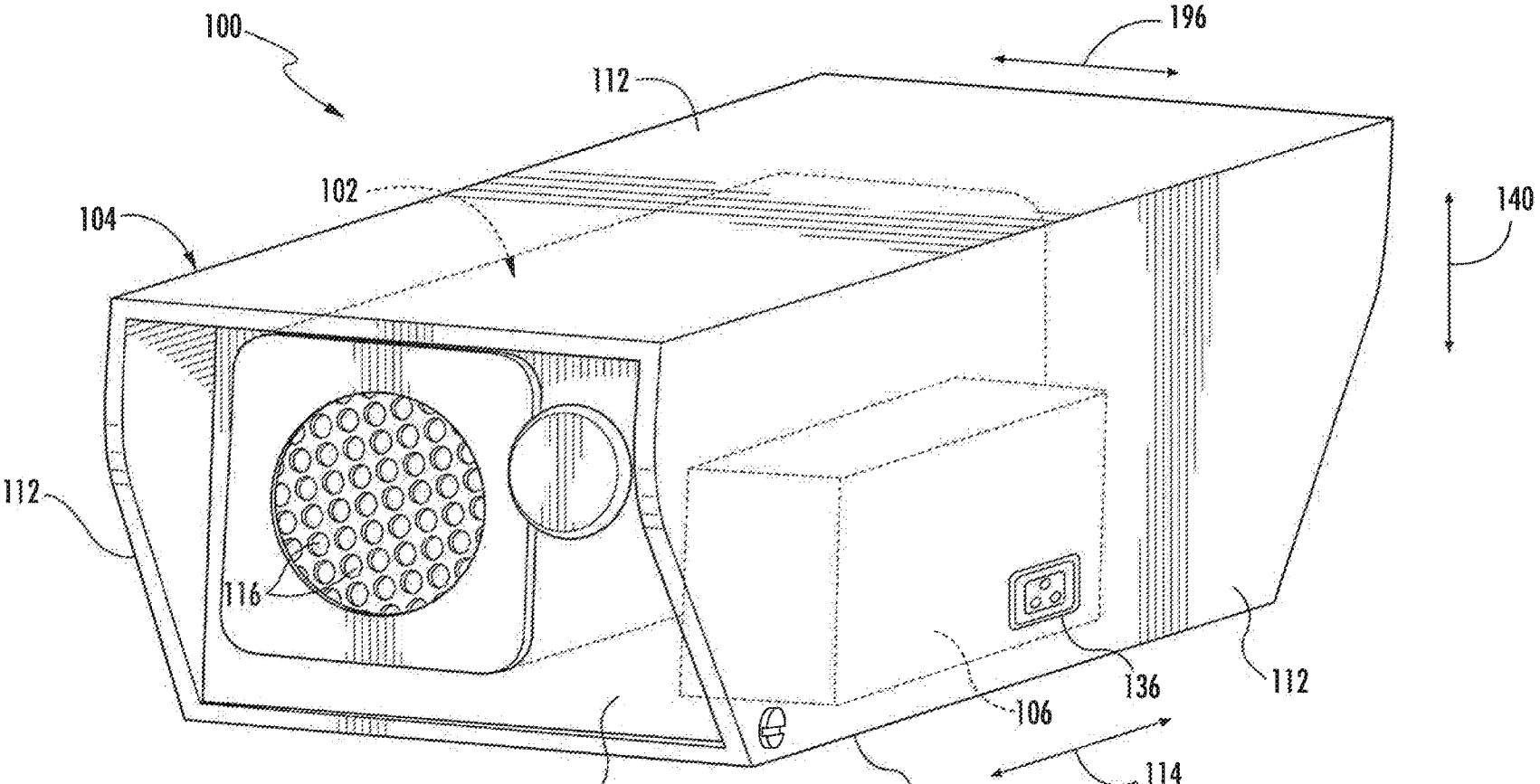
FIG. 1 illustrates a front perspective view of one embodiment of an electrostatic particle collector assembly in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to an electrostatic particle collector (ESP) with improved design features for facilitating removal and/or insertion of the collector plate(s) of the ESP. In several embodiments, the ESP may correspond to a modular collector cartridge that may be utilized in a connection with a separate controller or control device in order to control the operation of the various internal components of the collector cartridge (e.g., the fan, etc.) and/or to control the power supplied to the corona wire assembly of the collector cartridge. For example, as will be described below, in one embodiment, the collector cartridge may be utilized in connection with an ESP assembly including an outer housing configured to house both the collector cartridge and its separate controller.

To facilitate insertion of the collector plate(s) within the collector cartridge, one or more plate slots may be defined within a housing of the collector cartridge, with each plate slot being configured to receive a corresponding collector plate of the collector cartridge. For instance, in several embodiments, the cartridge housing may define a first plate slot and a second plate slot configured to receive first and second collector plates, respectively, of the collector cartridge. Each plate slot may be defined vertically within the housing and may include an open end at the top of the housing such that the corresponding collector plate may be inserted into the plate slot at its open end and slid or pushed downwardly into the slot.

Additionally, to facilitate removal of the first and second collector plates, first and second plate access windows may be defined in the housing (e.g., through opposed sidewalls of the housing) to provide access to the bottom edge of each collector plate. Specifically, as will be described below, each plate access window may be defined in the housing so as to provide a user access to the bottom end of each plate slot. As a result, a user of the collector cartridge may utilize his/her finger (or an appropriate tool) to contact the bottom edge of each collector plate and push the plate upward relative to the housing such that a portion of the plate extends vertically above the cartridge housing. The user may then contact or grab the side edges of the collector plate to pull the remainder of the plate from the housing. As will be apparent from the disclosure provided herein, such removal process may be completed without requiring the user to contact a collection surface of the collector plate, thereby minimizing and/or preventing sample loss and/or sample contamination as the plate is being removed from the housing.

Moreover, as will be described in greater detail below, the disclosed collector cartridge may also include various other design features configured to provide numerous advantages. For instance, the collector cartridge may include one or more interchangeable or modular components, such as a modular corona wire assembly and/or a modular inlet nozzle. As a result, such component(s) may be interchanged with another corresponding component(s) to allow the collector cartridge to achieve a desired performance for a given application. For instance, multiple corona wire assemblies may be provided for the collector cartridge, with each corona wire assembly having a different wire configuration (e.g., differing sizes, orientations and/or numbers of wires). In such instance, if a given wire configuration will provide the performance desired for the current application within which the collector cartridge is being utilized, a corona wire assembly having such wire configuration may be quickly and easily installed within the cartridge.

In addition, the disclosed ESP assembly may include a common input port (e.g., a multi-pin connector) that allows the assembly controller to accept inputs from any suitable external device. As a result, the controller may be electrically and/or communicatively coupled to any suitable external control device configured to control the operation of the cartridge and/or control the supply of power to the cartridge. Such versatility may allow the assembly be installed within and/or incorporated into any suitable device, system and/or other assembly to allow for the collection of airborne particles.

Figure 2:
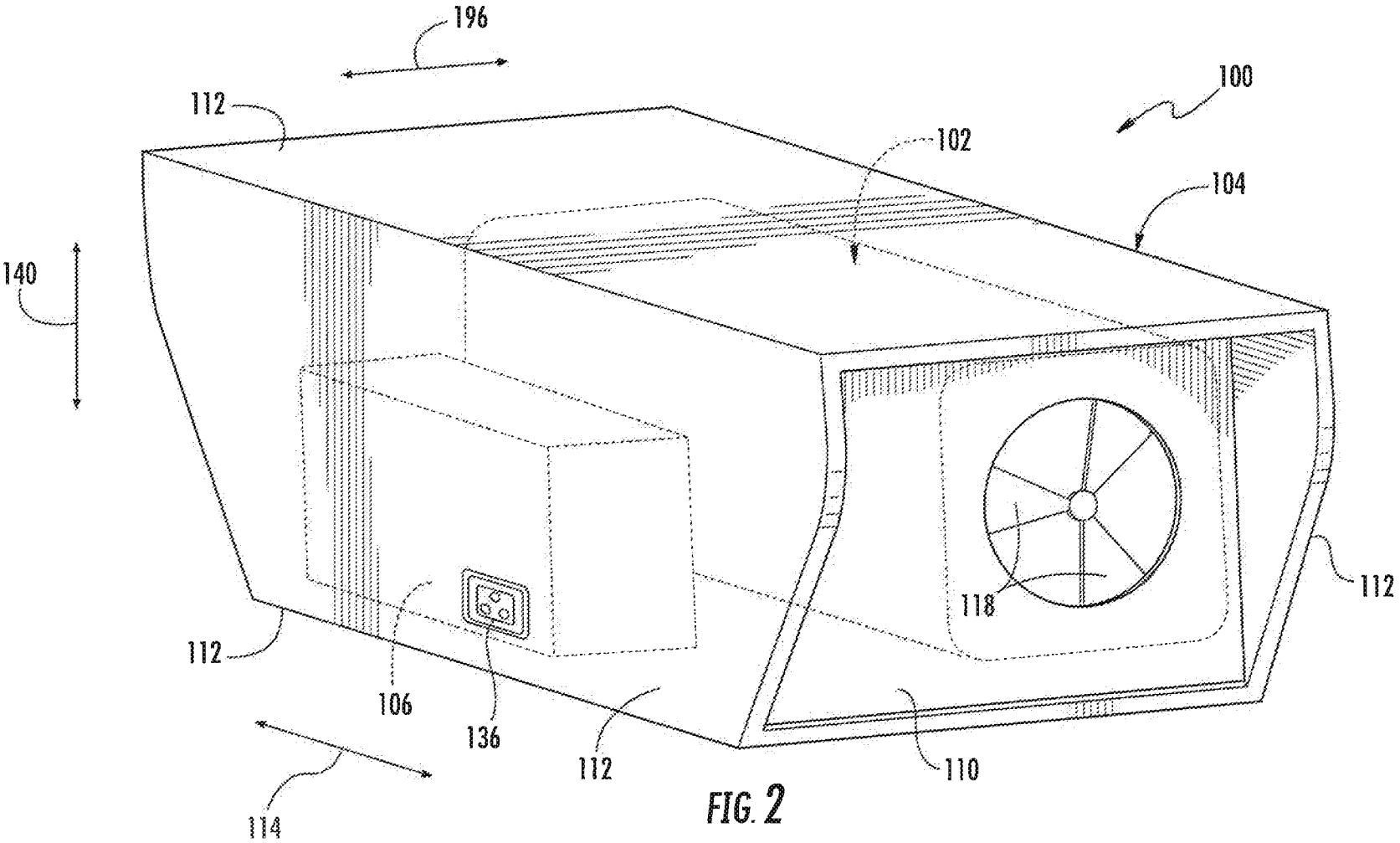
FIG. 2 illustrates a rear perspective view of the electrostatic particle collector assembly shown in FIG. 1.
Figure 3:
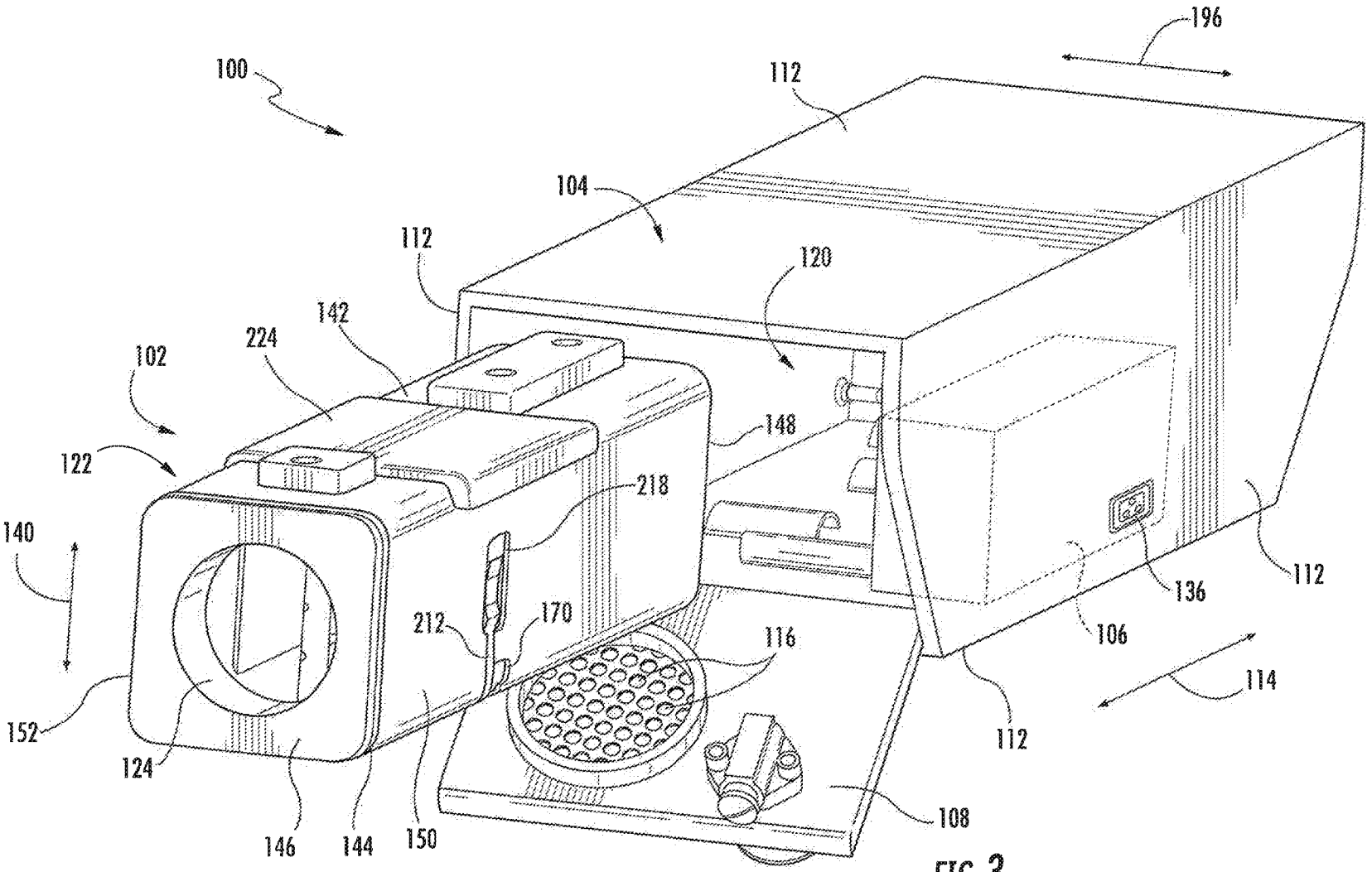
FIG. 3 illustrates another front perspective view of the electrostatic particle collector assembly shown in FIG. 1, particularly illustrating a collector cartridge of the assembly exploded away from an outer housing of the assembly.

Referring now to FIGS. 1-3, one embodiment of an electrostatic particle collector (ESP) assembly 100 is illustrated in accordance with aspects of the present subject matter. Specifically, FIG. 1 illustrates a front perspective view of the ESP assembly 100 and FIG. 2 illustrates a rear perspective view of the ESP assembly 100. In addition, FIG. 3 illustrates a similar perspective view of the ESP assembly 100 as that shown in FIG. 1, with a collector cartridge 102 of the ESP assembly 100 being exploded away from an outer housing 104 of the assembly 100.

As shown, the ESP assembly 100 may generally include a collector cartridge 102 and a separate controller 106 configured to be housed within an outer casing or housing 104 of the assembly 100. As will be described in more detail below, the collector cartridge 102 may correspond to a modular component of the ESP assembly 100 that may be inserted into and removed from the outer housing 106.

In general, the outer housing 104 of the ESP assembly 100 may be formed from any suitable material. For instance, in one embodiment, the outer housing 104 may be formed from a rigid material, such as a conductive metal material. Additionally, the outer housing 104 may generally have any suitable configuration that allows it to function as described herein. For instance, in the illustrated embodiment, the outer housing 104 generally defines a box-like configuration and includes a front wall 108, a rear wall 110 and a plurality of sidewalls 112 (e.g., four sidewalls) extending in a lengthwise direction of the ESP assembly 100 (indicated by arrow 114) between the front and rear walls 108, 110. As particularly shown in FIG. 1, the front wall 108 may define one or more inlet openings 116 (or may incorporate a component that defines one or more inlet openings 116) for receiving a gas flow (e.g., an air flow) within the outer housing 104. Moreover, as shown in FIG. 2, the rear wall 110 may define one or more outlet openings 118 (or may incorporate a component that defines one or more outlet openings 118) for expelling the gas flow from the outer housing 104.

In several embodiments, the front wall 108 may be pivotally coupled to one or more of the sidewalls 112 of the outer housing 104 to allow the wall 108 to be moved between a closed position (FIG. 1) and an opened position (FIG. 3). By moving the front wall 108 to the opened position, the collector cartridge 102 of the disclosed ESP assembly 100 may be removed from and/or inserted into the outer housing 106. Specifically, as shown in FIG. 3, when the front wall 108 is moved to the opened position, a large wall opening 120 may be defined at the front end of the outer housing 104 to allow the collector cartridge 102 to be inserted into the housing 104 and/or removed therefrom. In an alternative embodiment, it should be appreciated that the rear wall 110 may be pivotally coupled to one or more of the sidewalls 112 of the outer housing 104 to facilitate insertion/removal of the collector cartridge 102.

In general, the collector cartridge 102 may be configured to serve as the electrostatic particle collector for the ESP assembly 100. Thus, the collector cartridge 102 may generally include a cartridge housing 122 defining a flow path between an inlet orifice 124 (FIG. 3) defined at a front end of the cartridge housing 122 and an outlet orifice 126 (FIG. 5) defined at an opposite, rear end of the cartridge housing 122. In addition, the collector cartridge 102 may include a fan 128 (shown in dashed lines in FIG. 5) positioned within the cartridge housing 122 (e.g., at the rear end of the housing 122 adjacent to the outlet orifice 126) that is configured to create a gas flow through the collector cartridge 102. Specifically, upon rotation of the fan 128, air and/or any other suitable gas(es) from the surrounding environment may be drawn into the collector cartridge 102 via the inlet orifice 124, flow through the collector housing 122 and may be subsequently expelled therefrom via the outlet orifice 126. Moreover, as will be described below with reference to FIGS. 4-8, the collector cartridge 102 may also include various other components to facilitate the collection of airborne particles contained within the gas flow directed through the cartridge housing 122, such as a corona wire assembly 130 (FIG. 6), one or more collector plates 132, 134 (FIG. 6) and/or the like. For instance, as is generally understood, a voltage may be applied to the corona wire assembly 130 of the collector cartridge 102 in order to produce an electric corona discharge that ionizes the gas flow and any particles contained therein. The ionized particles may then be attracted to the collector plates 132, 134 and collected thereon.

It should be appreciated that the collector cartridge 102 may generally be configured to be installed within the outer housing 104 of the ESP assembly 100 such that the flow path defined by the cartridge housing 122 is generally aligned with the inlet and outlet openings 116, 118 of the outer housing 104. Specifically, the inlet orifice 124 of the collector cartridge 102 may be aligned with the inlet opening 116 of the outer housing 104 and the outlet orifice 126 of the collector cartridge 102 may be aligned with the outlet opening 118 of the outer housing. As such, when the collector cartridge 102 is properly installed within the outer housing 104, rotation of the fan 128 provided within the collector cartridge 102 may draw a gas flow through the inlet opening 116 of the outer housing 104 and into the collector cartridge 102 via its inlet orifice 124. The gas(es) flowing through the collector cartridge 102 may then be expelled from the ESP assembly 100 as it flows through the outlet orifice 126 of the collector cartridge 102 and is subsequently directed through the outlet opening 118 of the outer housing 104.

As indicated above, the controller 106 of the ESP assembly 100 may be housed within the outer housing 104 and may correspond to a separate component from the collector cartridge 102. In general, the controller 106 may be configured to be communicatively and/or electrically coupled to the collector cartridge 102 when the cartridge 102 is installed within the outer housing 104 to allow the controller 106 to control the operation of its various internal components. For instance, the controller 106 may be configured to control the operation of the fan 128, such as by turning the fan 128 on and off and/or setting/adjusting the rotational speed of the fan 128. Such control of the fan operation, particularly the fan speed, may provide for the performance/operation of the disclosed collector cartridge 102 to be adjusted as desired. For example, lower fan speeds may provide higher collection efficiencies and may have lower power requirements while potentially sacrificing on the overall number of particles collected. Similarly, high fan speeds may allow for the collector cartridge 102 to collect a higher overall number of particles, but may also result in lower collection efficiencies and higher power requirements for the collector cartridge 102. Thus, by selecting a particular rotational speed for the fan 128 (or by dynamically adjusting the fan speed during operation of the collector cartridge 102), the performance/operation of the cartridge 102 may be specifically tailored to meet the requirements of the desired application.

In addition, the controller 106 may be configured to control the supply of power to the collector cartridge 102. For instance, the controller 106 may be configured to control the distribution of both high and lower voltage power to the corona wire assembly 130. In addition, the controller 106 may be configured to dynamically adjust the power supplied to the corona wire assembly 130 in real time based on one or more changing operating parameters for the collector cartridge 102 (e.g., varying environmental conditions). Such dynamic control of the power supply may allow for the controller 106 to provide real time optimization of the corona voltage and also mitigate corona breakdown or arcing as it occurs.

It should be appreciated that the controller 106 may generally correspond to any suitable electronic device, control circuit and/or other component that allows the controller 106 to function as described herein. For instance, in several embodiments, the controller 106 may correspond to a processor-based device(s), such as a computing device(s) and/or a similar type of device(s). In such embodiments, the controller may, for example, include one or more processor(s) and associated memory device(s) configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory of the controller 106 may generally comprise memory element(s) including, but are not limited to, computer readable medium (e.g., random access memory (RAM)), computer readable non-volatile medium (e.g., a flash memory) and/or other suitable memory elements. Such memory may generally be configured to store suitable computer-readable instructions that, when implemented by the processor(s), configure the controller 106 to perform various computer-implemented functions, such as controlling the operation of the fan 128 and/or controlling the power supplied to the corona wire assembly 130.

It should also be appreciated that the controller 106 may be configured to be communicatively and/or electrically coupled to the collector cartridge 102 using any suitable means known in the art, such as a wired connection between the controller 106 and the collector cartridge 102. For example, in one embodiment, suitable electrical contacts (not shown), such as spring-type contacts, may be provided on the exterior of the cartridge housing that are configured to be electrically coupled to a corresponding connector (e.g., a sliding type connector) provided within the outer housing 106. In such an embodiment, when the collector cartridge 102 is properly installed within the outer housing 104, the contacts may be aligned with and contact the connector to allow the cartridge 102 to be communicatively and/or electrically coupled to the controller 106.

In addition, as shown in FIGS. 1-3, the ESP assembly 100 may also include an input port 136 configured to extend through a portion of the outer housing 122 (e.g., through one of the sidewalls 112) to allow the controller 106 to accept external inputs, such as control signals associated with controlling the speed of the fan 128 and/or controlling the power to be supplied to the corona wire assembly 130 and/or the fan 128. For instance, in one embodiment, the input port 136 may correspond to a multi-pin connector that allows a separate control device to be communicatively and/or electrically coupled to the various internal components of the collector cartridge 102. As such, the disclosed the ESP assembly 100 may be used not only as a stand-alone particle collector but also as part of any other suitable device, system and/or other assembly to facilitate the collection of airborne particles. For instance, the controller 106 may be coupled to a separate control module via the input port 136 to allow for the cartridge 102 to be activated/controlled remotely (e.g., via a smartphone or other device) and/or automatically based on a given trigger event (e.g., a contamination release, system outage, etc.).

Additionally, although not shown, it should be appreciated that the collector cartridge 102 may be configured to be directly or indirectly (e.g., via the controller 106) coupled to a power source for supplying power to the cartridge 102. For instance, in one embodiment, the ESP assembly 102 may include a power source incorporated therein, such as a battery configured to be housed within the outer housing 104. Alternatively, the power source may correspond to an external power source. In such instance, the collector cartridge 102 may be configured to be electrically connected to the external power source using any suitable means, such by using the input port 136 and/or any other suitable electrical connection means.

Figure 4:
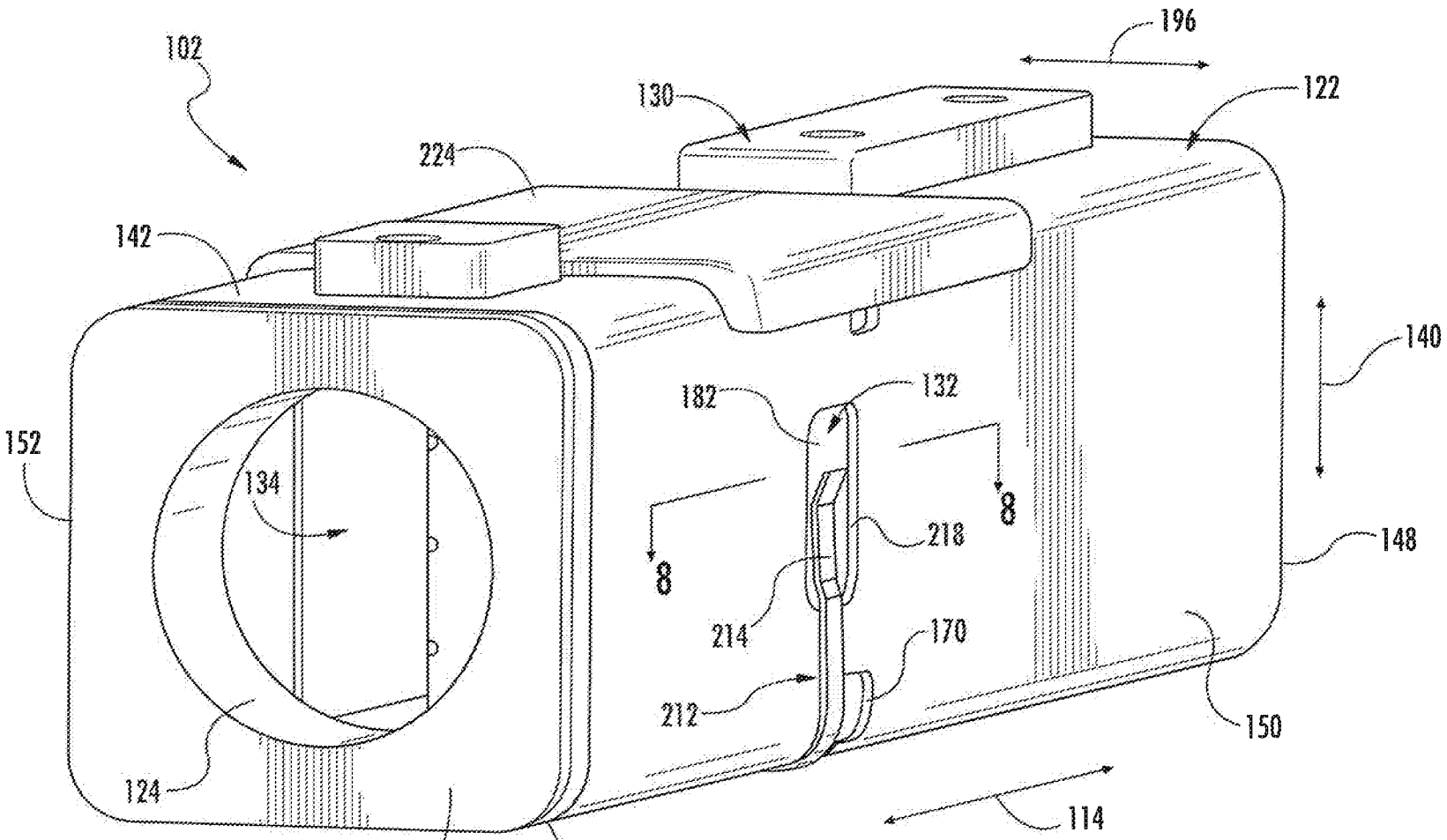
FIG. 4 illustrates a front perspective view of the collector cartridge shown in FIG. 3.
Figure 5:
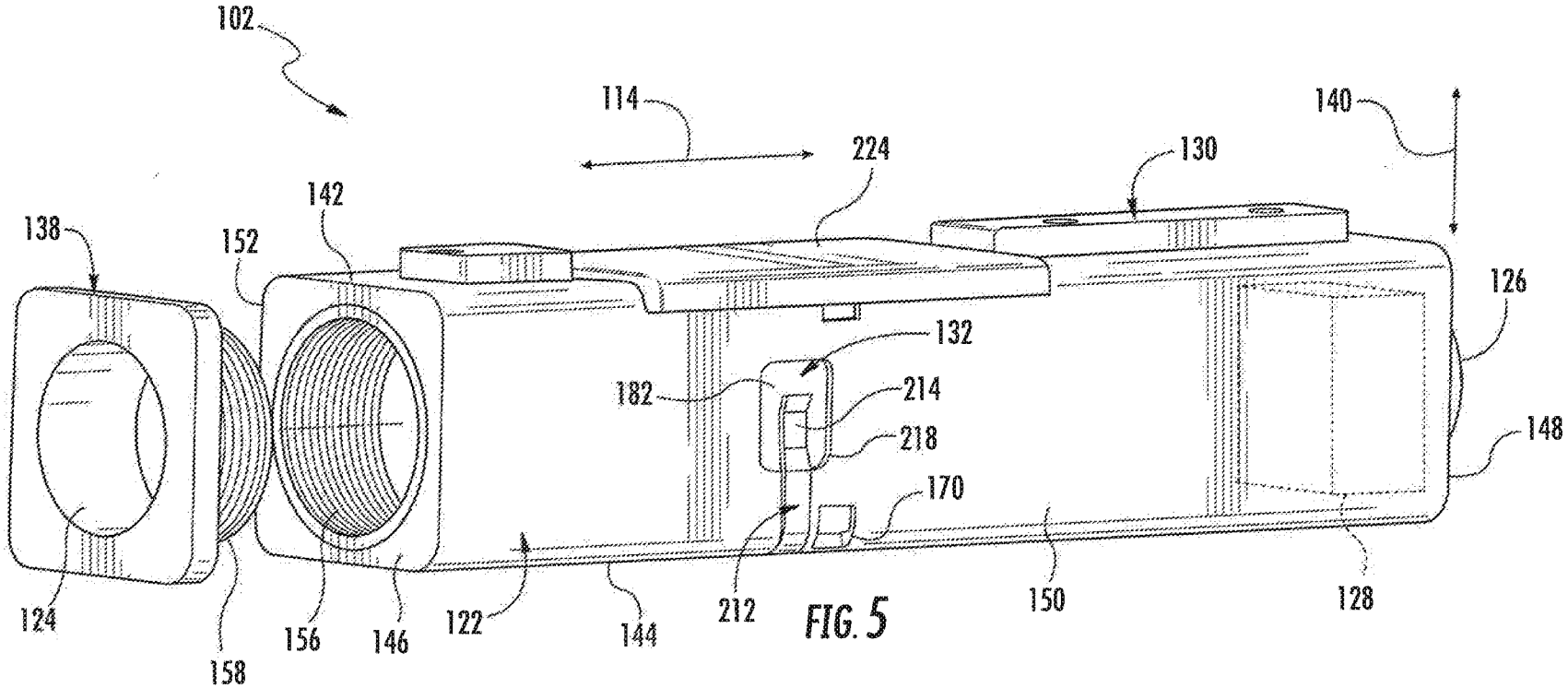
FIG. 5 illustrates another front perspective view of the collector cartridge shown in FIG. 4, particularly illustrating an inlet nozzle of the cartridge exploded away from a housing of the cartridge.
Figure 6:
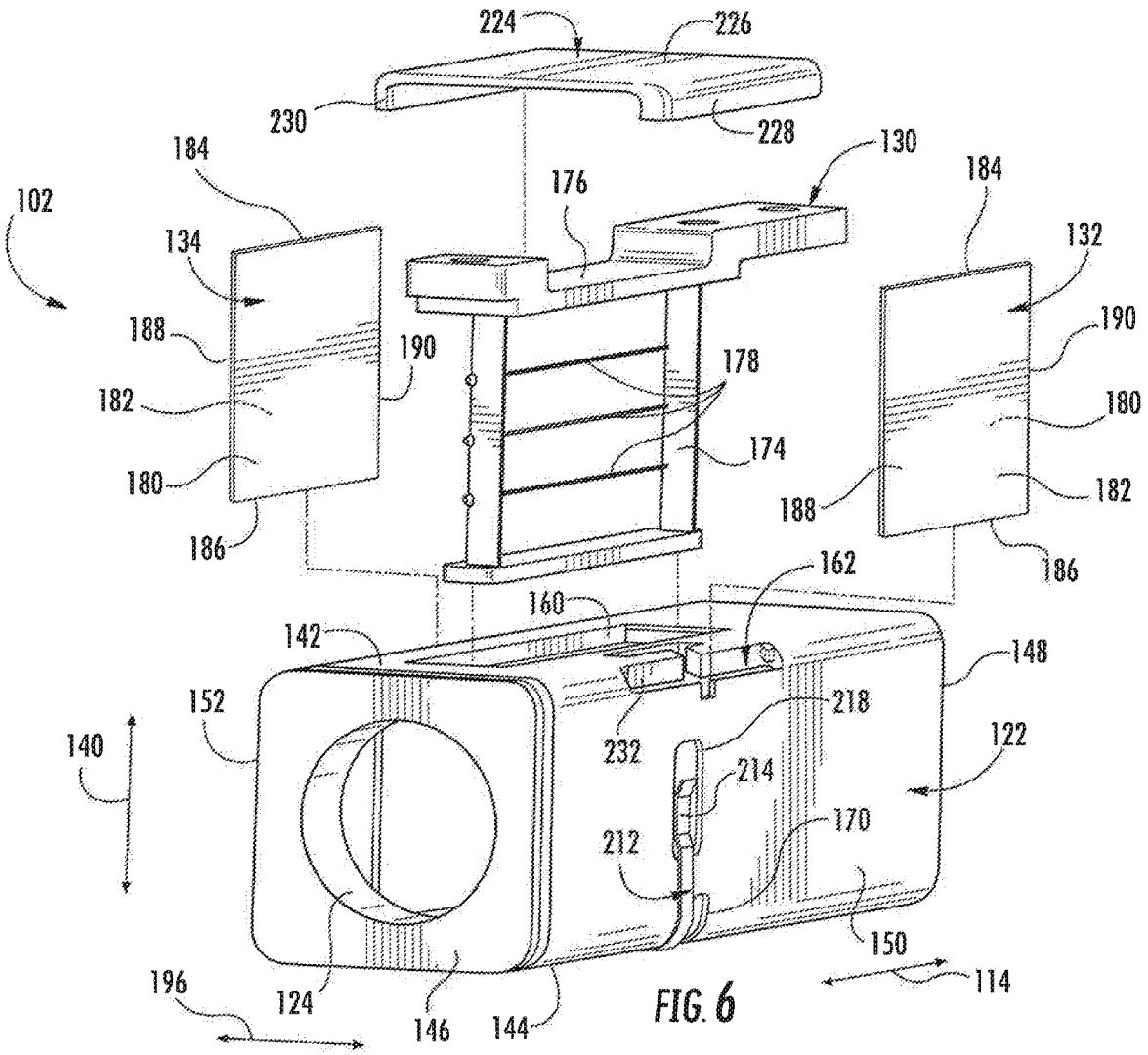
FIG. 6 illustrates another front perspective view of the collector cartridge shown in FIG. 4, particularly illustrating a removable cover, a corona wire assembly and first and second collector plates of the cartridge exploded away from the cartridge housing.
Figure 7:
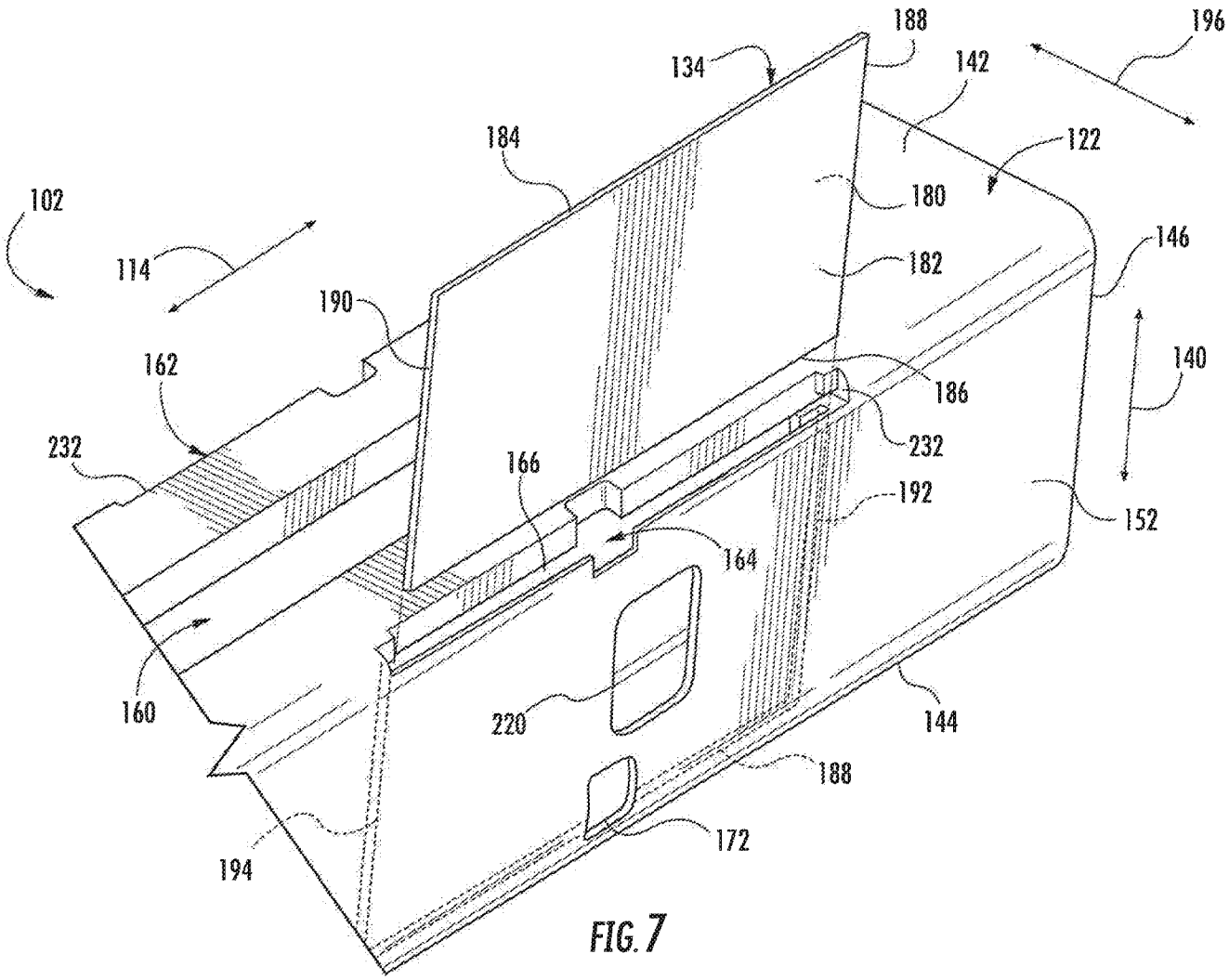
FIG. 7 illustrates a partial, top perspective view of the collector cartridge shown in FIG. 6 with one of the collector plates being exploded away from the cartridge housing, particularly illustrating a plurality of slots defined in the cartridge housing for installing and/or removing one or more of the modular components of the collector cartridge.
Figure 8:
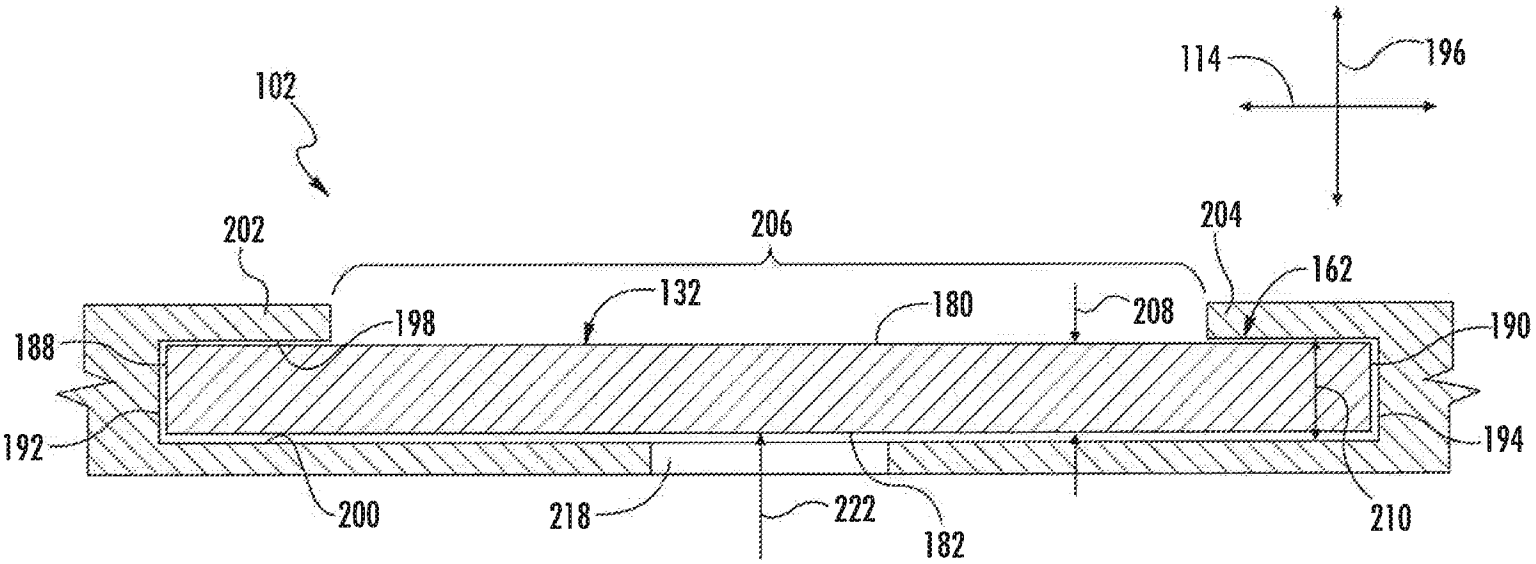
FIG. 8 illustrates a partial cross-sectional view of the collector cartridge shown in FIG. 4 taken about line 8-8.

Referring now to FIGS. 4-8, several views of the collector cartridge 102 described above with reference to FIGS. 1-3 are illustrated in accordance with aspects of the present subject matter. Specifically, FIG. 4 illustrates a front perspective view of the collector cartridge 102. FIG. 5 illustrates another front perspective view of the collector cartridge 102 shown in FIG. 4, particularly illustrating an inlet nozzle 138 of the collector cartridge 102 being exploded away from the cartridge housing 122. FIG. 6 illustrates a similar perspective view of the collector cartridge 102 as that shown in FIG. 4, with various components of the cartridge 102 being exploded away from the cartridge housing 122. FIG. 7 illustrates a partial, top perspective view of the cartridge housing 122 shown in FIG. 6 rotated 180 degrees, particularly illustrating a plurality of channels or slots defined along the top side the housing and one of the collector plates 134 of the collector cartridge 102 being exploded away from its corresponding slot. Additionally, FIG. 8 illustrates a partial, cross-sectional view of the collector cartridge 102 shown in FIG. 4 taken about line 8-8.

As shown in the illustrated embodiment, the cartridge housing 122 may be generally configured to house the various internal components of the collector cartridge 102. In general, the cartridge housing 122 may extend in a heightwise direction (indicated by arrow 140) between a top wall 142 and a bottom wall 144 and in a lengthwise direction (indicated by arrow 114) between a front end 146 and a rear end 148, with first and second sidewalls 150, 152 of the housing 122 extending heightwise between the top and bottom walls 142, 144 and lengthwise between the front and rear ends 146, 146. Additionally, as shown in FIGS. 4-6, the inlet orifice 124 of the collector cartridge 102 may be defined at or adjacent to the front end 146 of the cartridge housing 122 and the outlet orifice 126 (FIG. 5) of the collector cartridge 102 may be defined at or adjacent to the rear end 148 of the cartridge housing 122. In several embodiments, the inlet orifice 124 and/or the outlet orifice 126 may be defined by a separate component(s) configured to be coupled to the cartridge housing 122 at its front and/or rear ends 146, 148, respectively. For example, as particularly shown in FIG. 5, the inlet orifice 124 may be defined by an inlet nozzle 138 configured to be removably attached to the front end 146 of the cartridge housing 122. In such an embodiment, the inlet nozzle 138 may be configured to be coupled to the cartridge housing 122 using any suitable means. For instance, as shown in FIG. 5, a threaded opening 156 may be defined in the front end 146 of the cartridge housing 122 that is configured to receive a corresponding threaded portion 158 of the inlet nozzle 138. Alternatively, the inlet nozzle 138 may be removably coupled to the cartridge housing 122 using any other suitable means, such as mechanical fasteners and/or the like.

It should be appreciated that, by incorporating the inlet orifice 124 and/or the outlet orifice 126 into a component(s) configured to be removably coupled to the cartridge housing 122, the collector cartridge 102 may be provided with interchangeable gas flow components that allow its performance to be specifically tailored to meet the needs of the particular application within which it is being utilized. For instance, by providing an interchangeable inlet nozzle 138, the size and/or shape of the inlet orifice 124 may be selected so as to provide the desired amount of air flow through the collector cartridge 102.

It should also be appreciated that, in alternative embodiments, the inlet orifice 124 and/or the outlet orifice 126 may be defined entirely by the cartridge housing 122 and, thus, may not be incorporated into removable or interchangeable components. For instance, in one embodiment, the cartridge housing 122 may simply include front and rear walls at its front and rear ends 146, 148, respectively, with each wall defining an orifice that corresponds to the inlet orifice 124 or the outlet orifice 126 of the collector cartridge 102.

Additionally, as shown in the illustrated embodiment, the cartridge housing 122 may also define various openings, channels or slots for receiving one or more of the internal components of the collector cartridge 102. For instance, as particularly shown in FIGS. 6 and 7, a centrally located wire slot 160 may be defined through the top wall 142 of the cartridge housing 122 for receiving at least a portion of the corona wire assembly 130 of the collector cartridge 102. In addition, the cartridge housing 122 may define first and second plate slots 162, 164 for receiving corresponding first and second collector plates 132, 134, respectively, of the collector cartridge 102. As will be described below, each plate slot 162, 164 may be configured to extend in the heightwise direction 140 from an open top end 166 terminating at or adjacent to the top wall 142 of the cartridge housing 122 to a bottom end 168 (FIGS. 7 and 9-11) terminating adjacent to the bottom wall 144 of the cartridge housing 122. As such, each collector plate 132, 134 may be installed within the cartridge housing 122 by inserting the collector plate 132, 134 into the open top end 166 of its corresponding plate slot 162, 164 and by sliding or pushing the collector plate 132, 134 downward relative to the housing 122 towards the bottom end 168 of the slot 162, 164.

Moreover, the cartridge housing 122 may also define one or more features for facilitating removal of the collector plates 132, 134 from the cartridge housing 122. For instance, as will be described in greater detail below, the cartridge housing 122 may include a plate access window 170, 172 defined through each of its sidewalls 150, 152 at a location adjacent to the bottom end 168 of each plate slot 162, 164 that is configured to assist in removing each collector plate 132, 134 from its corresponding plate slot 162, 164.

Referring still to FIGS. 4-8, the corona wire assembly 130 of the collector cartridge 102 may generally have any suitable configuration that allows it to function as described herein with respect to its role in the collection of airborne particles. However, as indicated above, in several embodiments, the corona wire assembly 130 may correspond to a modular or interchangeable component that is configured to be inserted within and/or removed from the collector cartridge 102 via the wire slot 160 defined in the cartridge housing 122. For example, as shown in FIG. 6, the corona wire assembly 130 may include a bottom frame portion 174 configured to be inserted through the wire slot 160 and into the cartridge housing 122 and a top mounting portion 176 configured to extend along the top side of the cartridge housing 122 to facilitate coupling or mounting the corona wire assembly 130 to the housing 122 (e.g., via mechanical fasteners). Additionally, one or more corona wires 178 may be horizontally and/or vertically supported by the bottom frame portion 174 of the corona wire assembly 130. As such, when the bottom frame portion 174 is inserted into the cartridge housing 122 via the wire slot 160, the corona wire(s) 178 may be positioned within the flow path of the gas(es) directed through the housing 122.

It should be appreciated that, by configuring the corona wire assembly 130 as an interchangeable component, corona wire assemblies having various different wire configurations may be installed within the collector cartridge 102. For instance, the collection efficiency of the collector cartridge 102 may be varied based on the size, placement/orientation and/or number of the corona wires 178 utilized within the corona wire assembly 130. Thus, in accordance with aspects of the present subject matter, the corona wire assembly disclosed herein may allow users of the collector cartridge 102 to optimize the corona wire configuration used within the cartridge 102 to achieve the desired performance and/or results.

It should also be appreciated that, in alternative embodiments, the corona wire assembly 130 may correspond to a fixed or non-removable component of the collector cartridge 102. In such instance, the configuration of the corona wire assembly 130 and/or the housing 122 may be adjusted, as desired, to accommodate the corona wire assembly 130 being designed as a fixed or non-removable component of the collector cartridge 102.

As indicated above, the collector cartridge 102 may also include first and second collector plates 132, 134 configured to be installed within the interior of the cartridge housing 122 via respective first and second plate slots 162, 164. In general, each collector plate 132, 134 may include an inner face 180 and an outer face 182 extending in the heightwise direction 140 between a top edge 184 and a bottom edge 186 and extending in the lengthwise direction 114 between a first side edge 188 and a second side edge 190. As described herein, the inner face 180 of each collector plate 132, 134 may generally define the "collection" surface for the collector plate 132, 134 and may be configured to be exposed to the flow of gas(es) directed through the collector cartridge 102. In contrast, the outer face 182 of each collector plate 132, 134 may not be exposed to the flow of gas(es) through the collector cartridge 102. For instance, as will be described below, the outer face 182 of each collector plate 162, 164 may be configured to face outwardly towards and extend adjacent to the sidewall 150, 152 defining the outer surface of the plate slot 162, 164 within which the collector plate 132, 134 is installed.

To accommodate the collector plates 132, 134 within the cartridge housing 122, the plate slots 162, 164 may generally be configured to define a cross-sectional shape that allows each collector plate 132, 134 to be inserted into the housing 122 at the top end 166 of its corresponding plate slot 162, 164 and slid or pushed downwardly relative to the housing 122 towards the bottom end 168 of such slot 162, 164. For instance, in several embodiments, the plate slots 162, 164 may define a cross-sectional shape that is complementary to or otherwise matches the cross-sectional shape of the collector plates 132, 134. Specifically, as shown in the illustrated embodiment, each plate slot 162, 164 may define a generally rectangular cross-sectional shape that matches or corresponds to the rectangular cross-sectional shape of each collector plate 132, 134. For instance, as shown in the cross-sectional view of FIG. 8, each plate slot 162, 164 may define a rectangular shape extending in the lengthwise direction 114 between a first end 192 and a second end 194 and in a widthwise direction (indicated by arrow 196) between an outer surface 198 defined by the adjacent sidewall 150, 152 of the cartridge housing 122 and an inner surface 200 defined by opposed, first and second inner slot walls 202, 204 of the cartridge housing 122. As such, when each collector plate 132, 134 is installed within its corresponding plate slot 162, 164, the first and second side edges 188, 190 of the collector plate 132, 134 may be positioned adjacent to the first and second ends 192, 194 of the plate slot 162, 164 Similarly, as shown in FIG. 8, the outer face 182 of each collector plate 132, 134 may be positioned adjacent to and face outwardly towards the outer surface 198 of the plate slot 162, 164 defined by the adjacent sidewall 150, 152 whereas the inner face 180 of each collector plate 132, 134 may be positioned adjacent to and face inwardly towards the inner surface 200 of the plate slot 162, 164 defined by the opposed inner slot walls 202, 204.

It should be appreciated that each plate slot 162, 164 may be configured to be open towards the interior of the cartridge housing 122 so as to allow the inner face 180 of each collector plate 132, 134 to be exposed to the flow of gas(es) through the collector cartridge 102. For example, as shown in FIG. 8, the opposed inner slot walls 202, 204 of the housing 122 may be spaced apart from one another such that a significant gap 206 is defined between the slot walls 202, 204. As such, ionized particles flowing through the collector cartridge 202 may be collected along the exposed portion of the inner face 180 of each collector plate 132, 134 that extends in the lengthwise direction 114 along the gap 206 defined between the slot walls 202, 204.

It should also be appreciated that, in several embodiments, each collector plate 132, 134 may define a width 208 that is substantially equal to or slightly less than a corresponding width 210 of each plate slot 162, 164. For instance, in one embodiment, the width 208 of each collector plate 132, 134 may be equal to at least about 90% of the width 210 of its corresponding plate slot 162, 164, such as a width 208 equal to at least about 95% of the width 210 of the plate slot 162, 164 or at least about 98% of the width 210 of the plate slot 162, 164 or at least 99% of the width 210 of the plate slot 162, 164. By providing a relatively tight fit between the collector plates 132, 134 and the plate slots 162, 164, a sealed or substantially sealed interface may be defined between the inner face 180 of each collector plate 132, 134 and the inner surface 200 of each plate slot 162, 164 so as to prevent or substantially prevent any gases from flowing around each collector plate 132, 134 and through each plate slot 162, 164.

Figure 9:
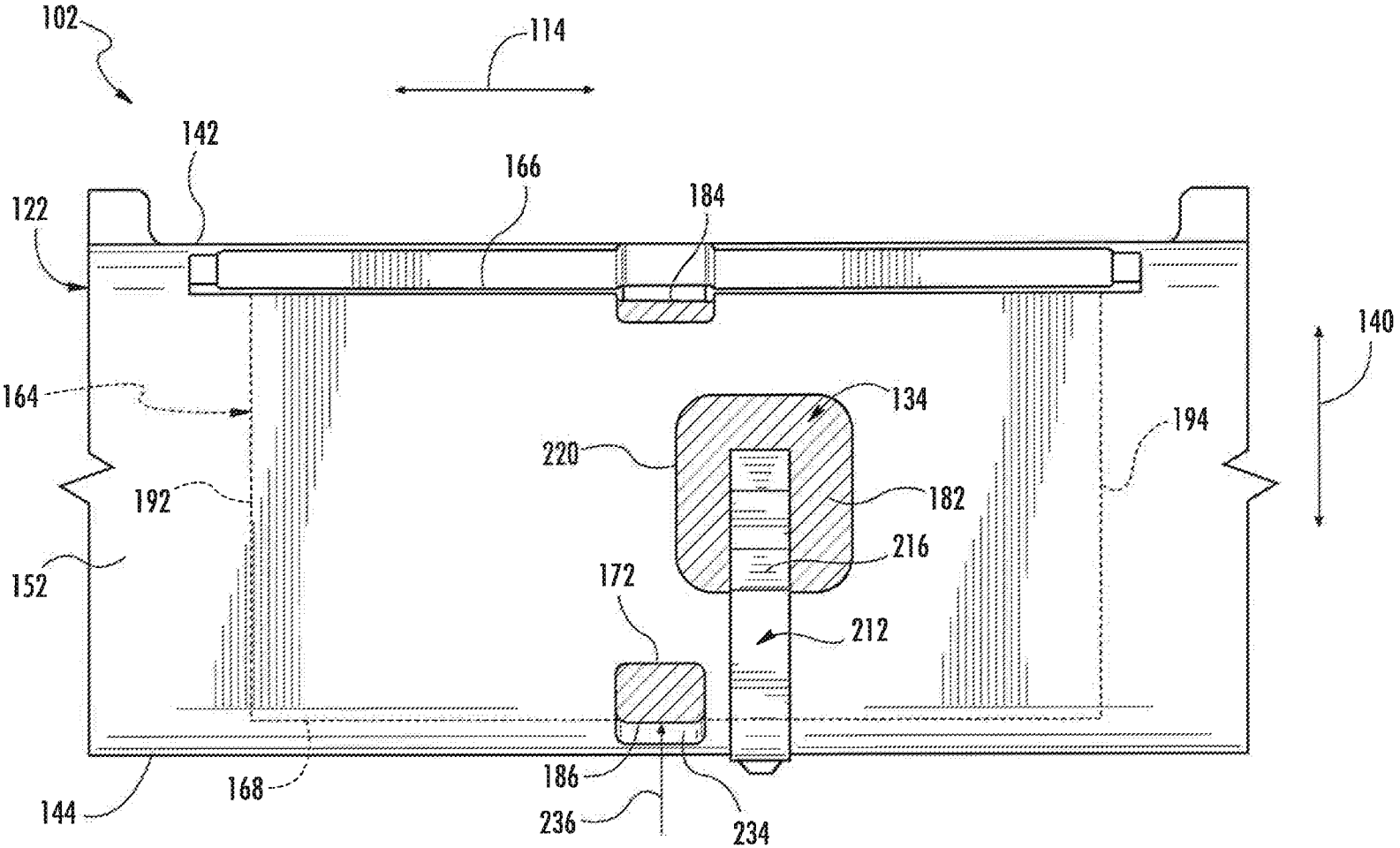
FIG. 9 illustrates a side view of the collector cartridge shown in FIG. 4 with a cover of the cartridge being removed, particularly illustrating one of the collector plates of the cartridge being fully installed within the cartridge housing.
Figure 10:
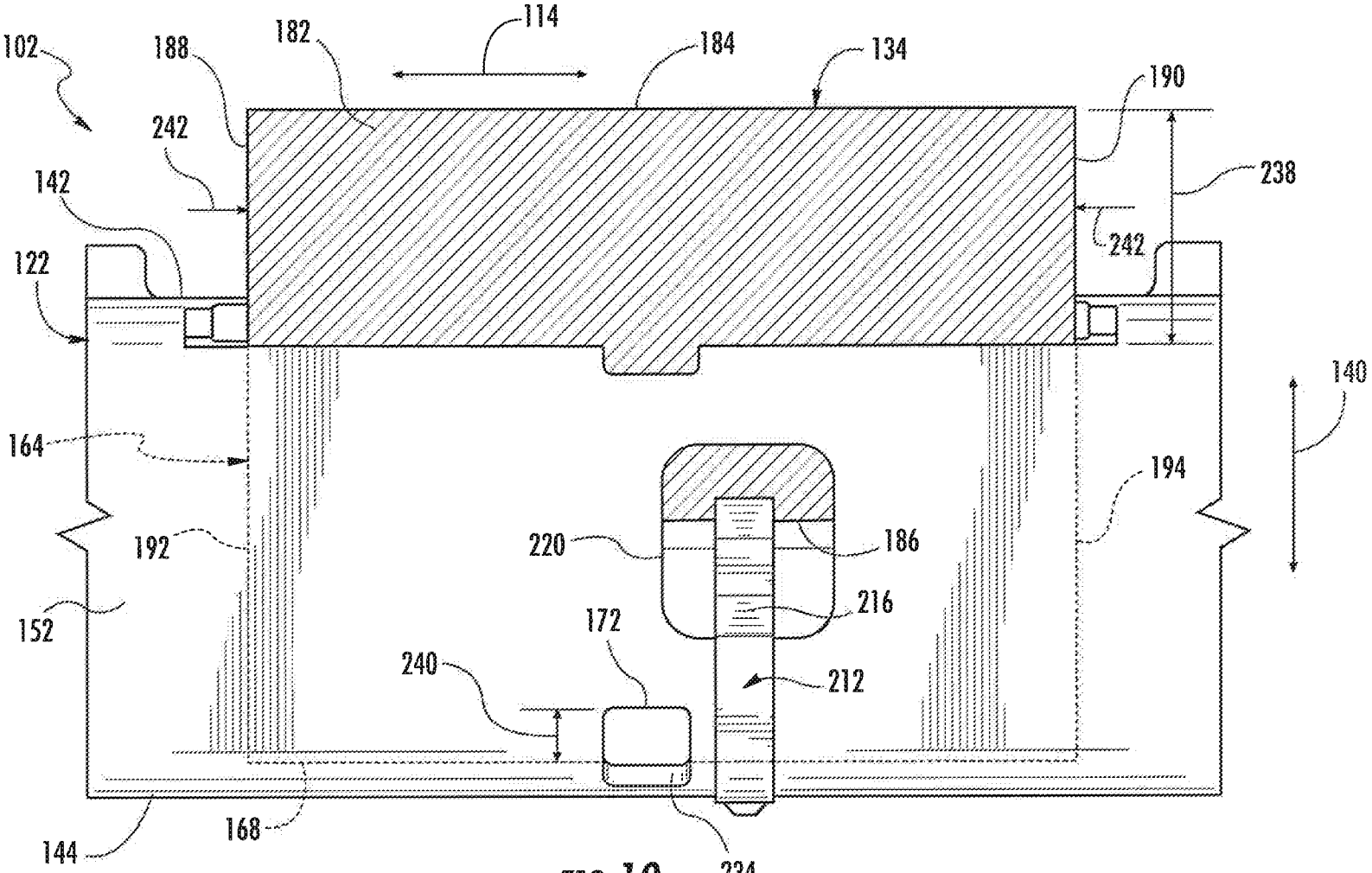
FIG. 10 illustrates a similar side view of the collector cartridge to that shown in FIG. 9, particularly illustrating the collector plate being partially removed from the cartridge housing.
Figure 11:
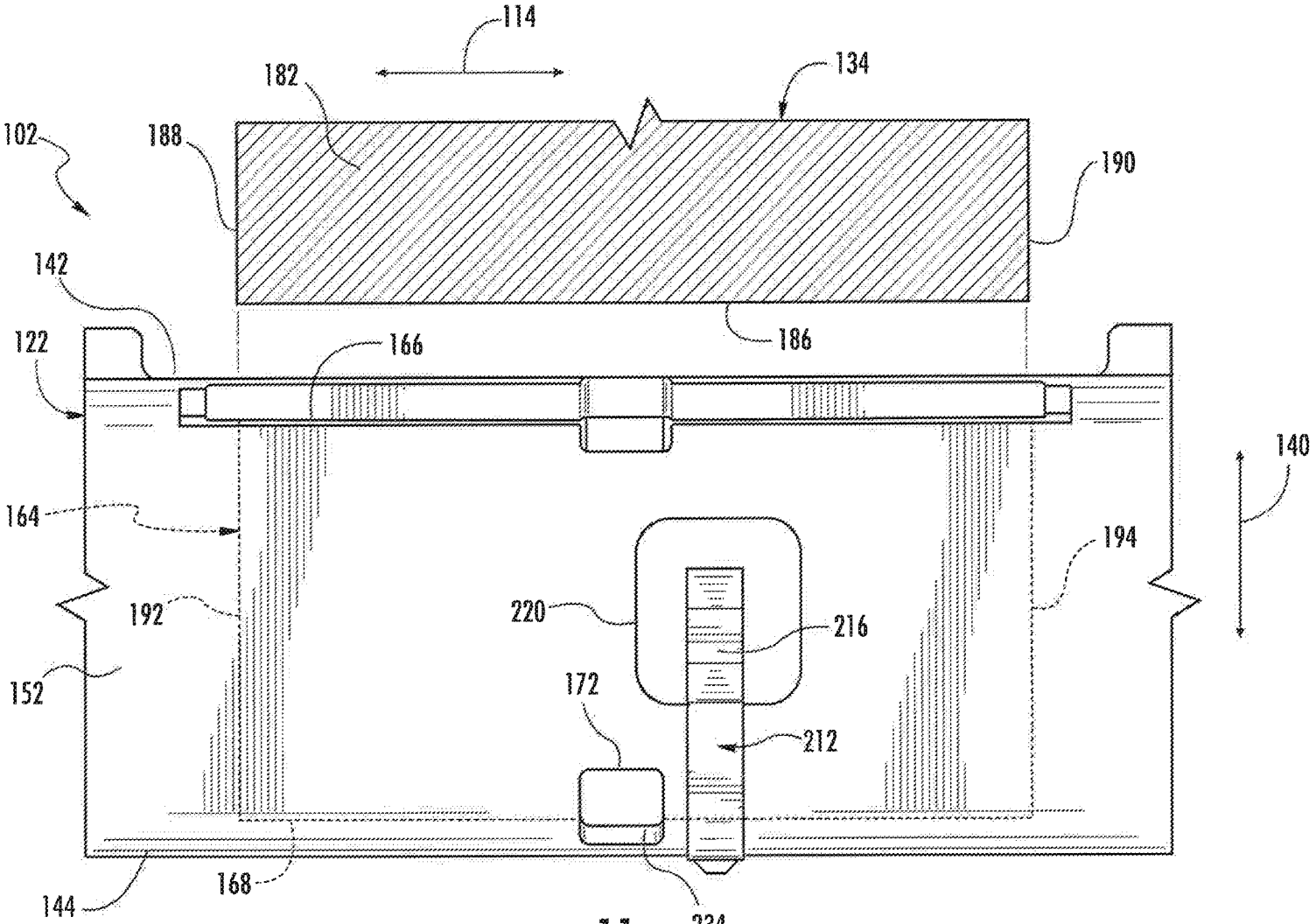
FIG. 11 illustrates a similar side view of the collector cartridge to that shown in FIGS. 9 and 10, particularly illustrating the collector plate being fully removed from the cartridge housing.

Referring still to FIGS. 4-8, the collector cartridge 102 may also include one or more grounding devices 212 for electrically connecting each collector plate 132, 134 to a reference or ground. As particularly shown in the illustrated embodiment, in one embodiment, the grounding device 212 may correspond to a grounding clip configured to be wrapped or clipped around the bottom wall 144 of the cartridge housing 122 such that first and second clip portions 214, 216 of the grounding device 212 extend upwardly from the bottom wall 144 along the first and second sidewalls 150, 152, respectively, of the cartridge housing 122. In such an embodiment, as shown in FIGS. 4-6, the first clip portion 214 may be configured to extend through a first ground opening 218 defined through the first sidewall 150 so as to allow the first clip portion 214 to electrically contact the outer face 182 of the first collector plate 132. Similarly, as shown in FIGS. 9-11, the second clip portion 216 may be configured to extend through a second ground opening 220 defined through the second sidewall 152 so as to allow the second clip portion 216 to electrically contact the outer face 182 of the second collector plate 134. The grounding device 212 may, in turn, be electrically connected to a reference or ground. For instance, in one embodiment, the grounding device 212 may be configured to electrically contact a suitable reference contained within the outer housing 104 of the ESP assembly 100 when the collector cartridge 102 is installed within the outer housing 104.

Moreover, in addition to providing a means for grounding the collector plates 132, 134, the grounding device 212 may also, in several embodiments, be configured to apply an inward force against each collector plate 132, 134 (e.g., as indicated by arrow 222 in FIG. 8) that serves to push the collector plates 132, 134 against the inner surfaces 198 of their respective plate slots 162, 164, thereby creating or enhancing the sealed interface defined between the inner face 180 of each collector plate 132, 134 and the inner surface 198 of its corresponding plate slot 162, 164. For example, the grounding device 212 may be formed from an elastic material that is configured to apply a reactive force against the collector plates 132, 134 due to the clip portions 214, 216 being deformed outwardly as the grounding device 212 is clipped onto or otherwise wrapped around the cartridge housing 122. Specifically, in one embodiment, the grounding device 212 may be formed from spring steel or a similar type of material. As such, when the grounding device 212 is installed onto the cartridge housing 122, each clip portion 214, 216 may apply an inwardly directed spring force against the adjacent collector plate 132, 134 so as to push the collector plate 132, 134 against the inner surface 198 of its corresponding plate slot 162, 164.

Additionally, in several embodiments, the collector cartridge 102 may also include a removable cover 224 configured to be positioned over a portion of the top wall 142 of the cartridge housing 122 so as to cover the wire slot 160 and/or the top ends 166 of the plate slots 162, 164. In such embodiments, the cover 224 may be removed to allow one or more of the modular components of the collector cartridge 102 to be installed, removed and/or replaced, such as the corona wire assembly 130 and/or the collector plates 132, 134. Once such modular component(s) has been installed, removed and/or replaced, the cover 224 may then be re-installed onto the housing 122 in order to cover the wire slot 160 and/or the plate slots 162, 164.

It should be appreciated that cover 224 may generally have any suitable configuration that allows it to function as described herein. For instance, as shown in FIG. 6, in one embodiment, the cover 224 may include a top portion 226 and first and second side portions 228, 230 extending outwardly from the top portion 226. In such an embodiment, the side portions 228, 230 of the cover 224 may be configured to be received within and/or extend across corresponding cover recesses 232 defined by the cartridge housing 122 directly above the plate slots 162, 164 to allow the cover 224 to be positioned over the plate slots 162, 164.

Referring now to FIGS. 9-11, various side views of the collector cartridge 102 described above with reference to FIGS. 1-8 are illustrated in accordance with aspects of the present subject, with a collector plate 132, 134 of the collector cartridge 102 being located in various different positions relative to the cartridge housing 122. Specifically, FIG. 9 illustrates a side view of the collector cartridge 102 with one of the collector plates 134 fully installed within the cartridge housing 122. FIG. 10 illustrates a similar side view of the collector cartridge 102 to that shown in FIG. 9 with the collector plate 134 being partially removed from the cartridge housing 122. Additionally, FIG. 11 illustrates a similar side view of the collector cartridge 102 to that shown in FIGS. 9 and 10 with the collector plate 134 being fully removed from the cartridge housing 122.

In general, a method for removing and/or installing the collector plates 132, 134 of the disclosed collector cartridge 102 will be described with reference to FIGS. 9-11. As indicated above, the configuration of the cartridge housing 122 may allow for the collector plates 132, 134 to be inserted and/or removed from the collector cartridge 102 in an efficient and effective manner. Of particular importance, the housing configuration allows for the removal of the collector plates 132, 134 without requiring contact with the inner face 180 (i.e., the "collection" face) of each collector plate 132, 134, thereby minimizing and/or preventing sample loss and sample contamination.

As particularly shown in FIG. 9, when each collector plate 132, 134 is properly installed within its corresponding plate slot 162, 164, the bottom edge 186 of the collector plate 132, 134 may be accessible from the exterior of the cartridge housing 122 via the plate access window 170, 172 defined through the adjacent sidewall 150, 152. For example, each plate access window 170, 172 may extend inwardly relative to the adjacent sidewall 150, 152 such that a recessed section 234 is formed in the housing 122 along the bottom end 168 of the plate slot 162, 164 at a location across which the bottom edge 186 of the collector plate 132, 134 extends. As such, a user of the collector cartridge 102 may place his/her finger (or an appropriate tool) within the recessed section 234 formed by the plate access window 170, 172 to access or otherwise contact the bottom edge 186 of the collector plate 132, 134.

As shown in FIG. 9, to remove the collector plate 132, 134 from the cartridge housing 122, an upward force (indicated by arrow 236 in FIG. 9) may be applied to the bottom edge 186 of the collector plate 132, 134 to push the plate 132, 134 upwardly relative to the housing 122. For example, the user of the collector cartridge 102 may utilize his/her finger (or an appropriate tool) to push the collector plate 132, 134 by placing his/her finger (or tool) directly below the bottom edge 186 of the collector plate 132, 134 within the recessed portion 234 of the housing 122 formed by the plate access window 170, 172 and pressing upwardly against the bottom edge 186. Such application of an upward force against the bottom edge 186 of the collector plate 132, 134 may cause the collector plate 132, 134 to be moved upwardly relative to the cartridge housing 122 in the direction of the top wall 142 of the housing 122.

It should be appreciated that, although the plate access windows 170, 172 are described herein as being defined through the sidewalls 150, 152 of the cartridge housing 122, the access windows 170, 172 may generally be defined at any suitable location that allows a user to gain access to the bottom edge 186 of each collector plate 132, 134. For instance, in an alternative embodiment, the plate access windows 170, 172 may be defined through the bottom wall 144 of the cartridge housing 122 or may be defined in both the sidewalls 150, 152 and the bottom wall 144 of the cartridge housing 122.

As the collector plate 132, 134 is pushed upwardly and out of its plate slot 162, 164 via application of the upward force against the bottom edge 186 of the plate 132, 134, a clearance distance 238 (FIG. 10) may be defined between the top edge 184 of the collector plate 132, 134 and the top end 166 of its corresponding plate slot 162, 164. Depending on the configuration of the plate access window 170, 172 and/or the object being used to apply the upward force, the clearance distance 238 may be equal to or less than a corresponding height 240 (FIG. 10) of the access window 170, 172 extending above the bottom end 168 of the plate slot 162, 164 or the clearance distance 238 may be greater than such height 240. Regardless, the collector plate 132, 134 may be pushed upwardly relative to the housing 122 until a sufficient clearance distance 238 is defined between the top edge 184 of the collector plate 132, 134 and the top end 166 of the plate slot 162, 164 to allow the user to contact or grab the side edges 188, 190 of the collector plate 132, 134. The user may then pull the collector plate 132, 134 out of the cartridge housing 122 via by contacting the portions of the side edges 132, 134 exposed along the clearance distance 238. For example, as indicated by the arrows 242 in FIG. 10, the user may press his/her fingers into the side edges 188, 190 of the collector plate 132, 134 to allow the user to grip or grab the plate 132, 134. The user may then simply pull the collector plate 132, 134 upward to remove it from the housing 122 without requiring the user to contact the inner face 180 of the plate 132, 134.

Similarly, when installing each collector plate 132, 134 within its corresponding plate slot 162, 164, the bottom edge 186 of the collector plate 132, 134 may be inserted into the plate slot 162, 164 at its top end 166 while the user is gripping or contacting the side edges 188, 190 of the plate 132, 134. Once the bottom edge 186 of the collector plate 132, 134 has been inserted into the plate slot 162, 164, the user may then press against the top edge 184 of the collector plate 132, 134 to push the plate 132, 134 downwardly within the plate slot 162, 164 until the bottom edge 186 of the collector plate 132, 134 contacts or is otherwise positioned adjacent to the bottom end 168 of the plate slot 162, 164. At such point, the bottom edge 186 of the collector plate 132, 134 may then be accessible via the plate access window 170, 172 to allow for the subsequent removal of the plate 132, 134.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electrostatic particle collector, comprising:

a housing including first and second sidewalls extending lengthwise between a first end and a second end, the housing defining a plate slot that extends heightwise within the housing between a top end and a bottom end, the housing further including a plate access window defined through the housing so as to provide access to the bottom end of the plate slot;

a collector plate configured to be installed within the plate slot, the collector plate extending heightwise between a top edge and a bottom edge and lengthwise between a first side edge and a second side edge, wherein, when the collector plate is installed within the plate slot, the bottom edge of the collector plate is accessible from an exterior of the housing via the plate access window so as to allow the bottom edge of the collector plate to be moved in the direction of the top end of the plate slot to facilitate removal of the collector plate from the housing.

2. The electrostatic particle collector of claim 1, wherein the housing further defines a second plate slot that extends heightwise within the housing between a top end and a bottom end, the housing including a second plate access window defined through the housing so as to provide access to the bottom end of the second plate slot.

3. The electrostatic particle collector of claim 2, further comprising a second collector plate configured to be installed within the second plate slot, the second collector plate extending heightwise between a top edge and a bottom edge and lengthwise between a first side edge and a second side edge, wherein, when the second collector plate is installed within the second plate slot, the bottom edge of the second collector plate is accessible from the exterior of the housing via the second plate access window so as to allow the bottom edge of the second collector plate to be moved in the direction of the top end of the plate slot to facilitate removal of the second collector plate from the housing.

4. The electrostatic particle collector of claim 1, further comprising a grounding device configured to extend through a ground opening defined through the housing so as to electrically contact an outer face of the collector plate.

5. The electrostatic particle collector of claim 4, wherein the grounding device is configured to apply an inward force against the outer face of the collector plate such that an opposite inner face of the collector plate is pressed against an inner surface of the plate slot.

6. The electrostatic particle collector of claim 1, further comprising a corona wire assembly configured to be at least partially installed within the housing.

7. The electrostatic particle collector of claim 1, further comprising a fan configured to be installed within the housing.

8. The electrostatic particle collector of claim 1, wherein an inlet orifice is defined at or adjacent to the first end of the housing and an outlet orifice is defined at or adjacent to the second end of the housing.

9. The electrostatic particle collector of claim 1, wherein the inlet orifice is defined by an inlet nozzle configured to be removably coupled to the housing.

10. The electrostatic particle collector of claim 1, further comprising an input port associated with housing, the input port being configured to be coupled to a separate control device.

11. A method for removing and/or installing components used within an electrostatic particle collector, the electrostatic particle collector including a housing and a collector plate, the housing including first and second sidewalls extending lengthwise between a first end and a second end of the housing, the housing defining a plate slot adjacent that extends heightwise within the housing between a top end and a bottom end, the method comprising:

accessing, when the collector plate is installed within the housing, a bottom edge of the collector plate via a plate access window defined through the housing, the plate access window being defined through the housing at a location adjacent to the bottom end of the plate slot; and applying a force against the bottom edge of the collector plate so as to cause the collector plate to move relative to the housing in the direction of the top end of the plate slot.

12. The method of claim 11, wherein applying the force against the bottom edge of the collector plate comprises applying the force against the bottom edge such that the collector plate is moved relative to the housing until a clearance distance is defined between a top edge of the collector plate and the top end of the plate slot.

13. The method of claim 12, further comprising contacting portions of opposed side edges of the collector plate extending along the clearance distance defined between the top edge of the collector plate and the top end of the plate slot.

14. The method of claim 13, further comprising removing the collector plate from the plate slot by contacting the opposed side edges and moving the collector plate away from the housing.

15. The method of claim 11, further comprising installing the collector plate within the housing by inserting the bottom edge of the collector plate through the top end of the plate slot.

16. The method of claim 15, further comprising moving the collector plate relative to the housing until the bottom edge of the collector plate is located adjacent to the bottom edge of the plate slot and is accessible via the plate access opening.

17. The method of claim 11, further comprising positioning a grounding device relative to the housing such that a portion of the grounding device extends through a ground opening defined in the housing and contacts an outer face of the collector plate.

18. The method of claim 17, wherein the grounding device is configured to apply an inward force against the outer face of the collector plate such that an inner face of the collector plate is pressed against an inner surface of the plate slot.

19. The method of claim 11, wherein the electrostatic particle collector further comprises a corona wire assembly, further comprising installing a portion of the corona wire assembly into the housing via a wire slot defined through the housing.

20. The method of claim 11, wherein the electrostatic particle collector further comprises a removable cover configured to be coupled to a wall of the housing so as to cover the plate slot, further comprising removing the cover from the housing prior to moving the collector plate relative to the housing.

* * * * *